United States Patent [19]

Dupre, III

[11] 4,201,652

[45] May 6, 1980

[54] ELECTROLYTIC CELL MEMBRANE SEALING MEANS

[75] Inventor: Dallas D. Dupre, III, Pittsburgh, Pa.

[73] Assignee: PPG Industries, Inc., Pittsburgh, Pa.

[21] Appl. No.: 963,246

[22] Filed: Nov. 22, 1978

[51] Int. Cl.[2] ..... C25B 9/00; C25B 11/02; C25B 11/04; C25B 13/08

[52] U.S. Cl. ..... 204/258; 204/266; 204/270; 204/279; 204/295

[58] Field of Search ..... 204/252-258, 204/263-266, 279, 267-270, 290 F, 296, 295

[56] References Cited

U.S. PATENT DOCUMENTS

| | | | |
|---|---|---|---|
| 1,753,123 | 4/1930 | Krebs | 204/253 |
| 3,878,082 | 4/1975 | Gokhale | 204/252 X |
| 3,980,544 | 9/1976 | Adams et al. | 204/267 X |

*Primary Examiner*—John H. Mack
*Assistant Examiner*—D. R. Valentine
*Attorney, Agent, or Firm*—Richard M. Goldman

[57] ABSTRACT

Disclosed is an electrolytic cell having an electrode assembly with a base plate, fingered electrodes electrically connected to, spaced from, and extending outwardly from the base plate, and defining valleys between adjacent electrodes. The electrodes have a synthetic separator on their surface. The electrode assembly also has a back screen at the bases of the electrodes which is spaced from and parallel to the base plate. The electrolytic cell is characterized by providing compressive means between each pair of electrodes. The compressive means bear upon the electrode unit and upon the laps of the synthetic separators on adjacent electrodes to form electrolyte-tight seals between the separators.

9 Claims, 3 Drawing Figures

ELECTROLYTIC CELL MEMBRANE SEALING MEANS

DESCRIPTION OF THE INVENTION

Chlorine and alkali metal hydroxides, e.g., caustic soda and caustic potash, are commercially prepared in an electrolytic cell having two electrolyte compartments. One electrolyte compartment is the anolyte compartment having an acidic anolyte with a pH of from about 2.5 to about 5.5. In the anolyte compartment, chlorine is evolved at the anode. The other compartment, that is, the catholyte compartment, has an alkaline catholyte containing in excess of one mole per liter of alkali metal hydroxide. Hydrogen is evolved at the cathode.

The anolyte and catholyte are separated by a suitable separator, i.e., a diaphragm or membrane, which separates the acidic anolyte from the alkaline catholyte. The diaphragm, which may be a microporous diaphragm, allows chloride ion to diffuse through the separator, thereby providing a cell liquor of alkali metal hydroxide and salt.

Alternatively, a permionic membrane may be positioned between the anolyte liquor and catholyte liquor, providing a substantially chloridefree cell liquor. By a permionic membrane is meant a cation selective permionic membrane. Typically, such cation selective permionic membranes are fabricated of a fluorocarbon resin with pendant active acid groups such as carboxylic acid groups, sulfonic acid groups, derivatives of these groups, and precursors of those groups.

In electrolytic cells of the prior art, the separator was an asbestos diaphragm. However, more recently, the use of synthetic separators such as separators made of fluorocarbon resins, for example, microporous diaphragms and permionic membranes, has been necessitated by operational and economic considerations.

The fluorocarbon resins utilized in forming synthetic separators are difficult to join. This is especially so when contrasted to the vacuum deposition of prior art asbestos diaphragms. In particular, it is difficult to form the complex shapes that are needed for fingered electrodes. These complex shapes require joints, seams, and convolutions. In order to properly join the membrane material, high temperatures or strong reagents or both are necessary. These high temperatures and strong reagents may be deleterious to the electrodes. This is because the anodes have a catalytic coating thereon, as may the cathodes. Additionally, the avoidance of joints and seams provides a practical means of applying a membrane.

It has now been found that a particularly satisfactory electrolytic cell design may be provided having individual synthetic separator gloves for each membrane-bearing electrode, with laps of separator material at the open edges of the membrane glove at the electrode base. These laps overlap the laps of gloves of adjacent fingers and are held in compression by suitable compression means joined to the electrode unit. In this way, an electrolyte-tight seal is provided without complex post-assembly seaming and joining.

THE FIGURES

DETAILED DESCRIPTION OF THE INVENTION

Figure 1:
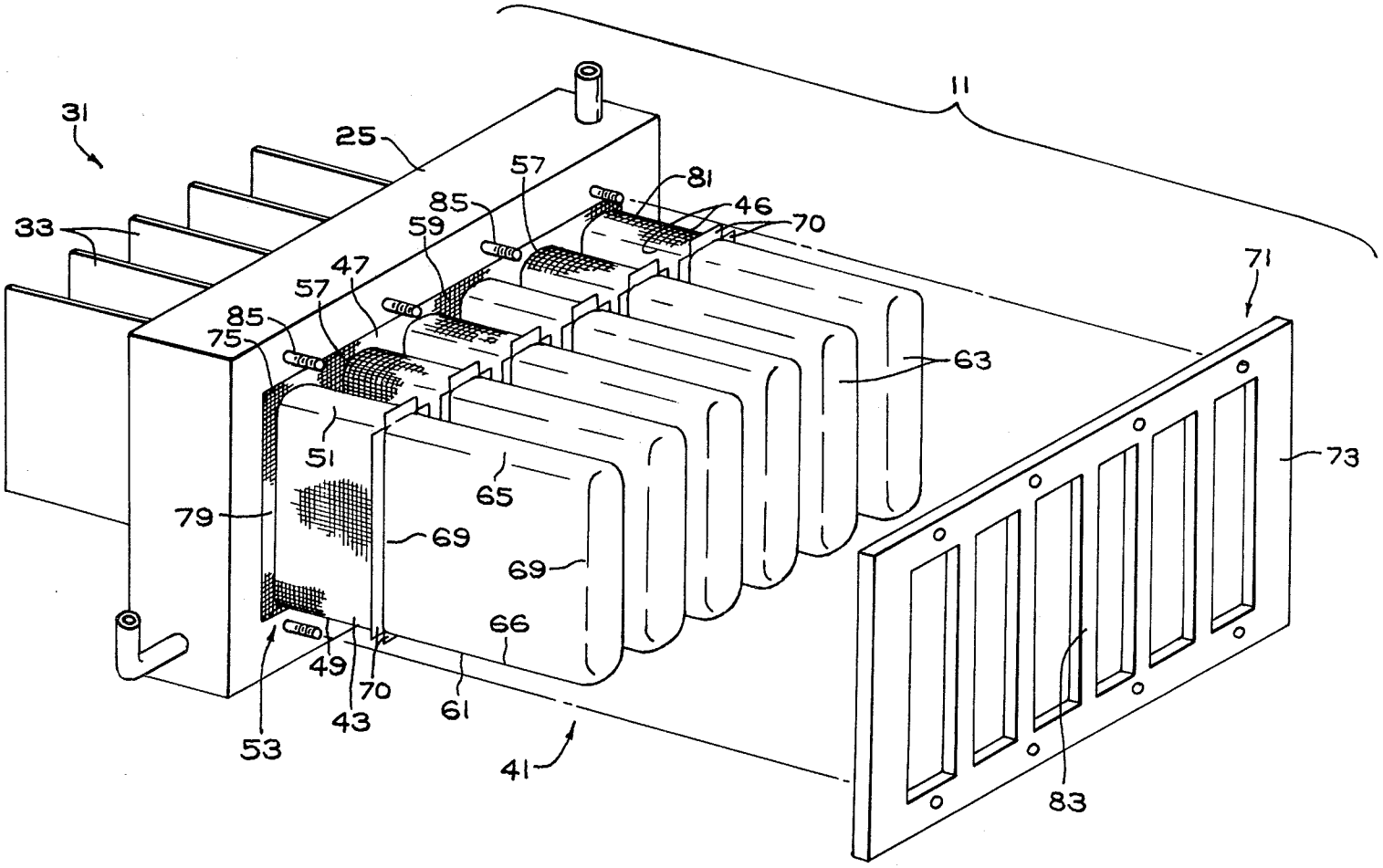
FIG. 1 is an exploded perspective view of an electrode unit showing the electrode base, the back screen, the electrode fingers, the membrane fingers, and the compressive means.
Figure 2:
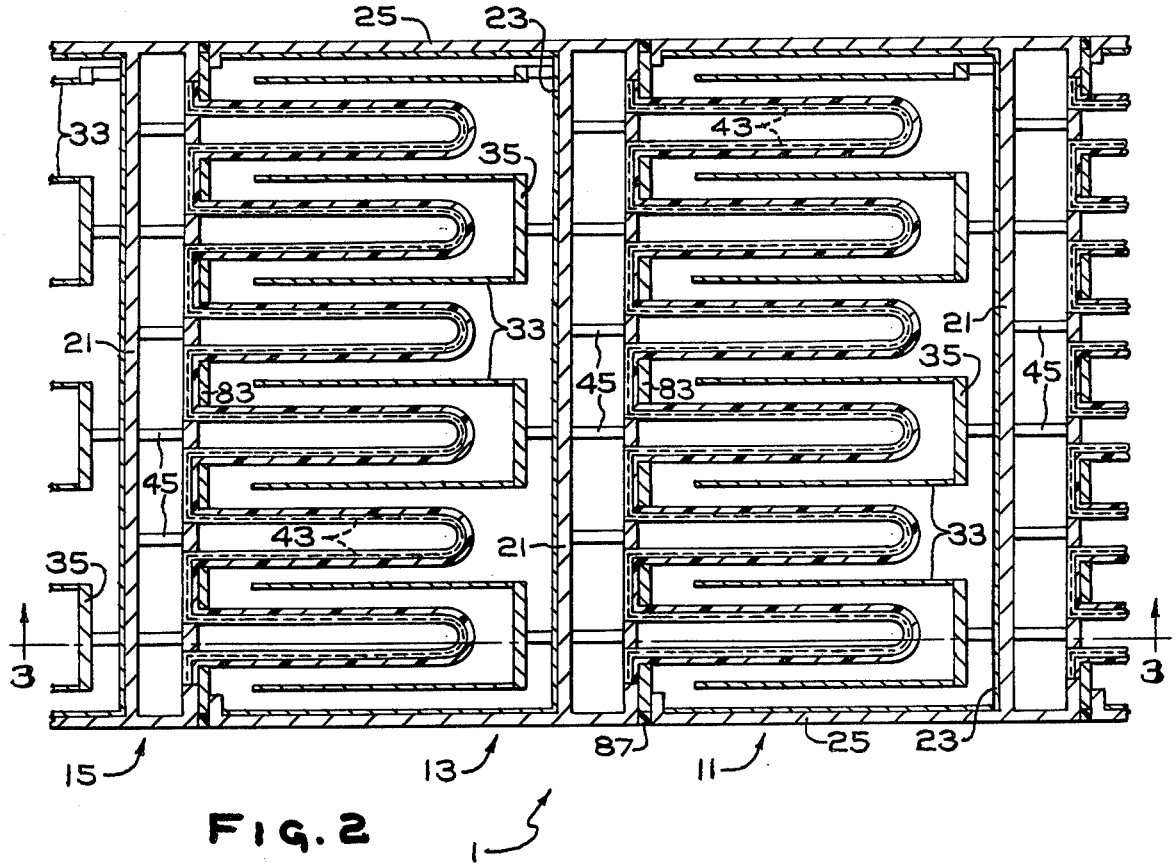
FIG. 2 is a cutaway top view of a bipolar electrolyzer along plane 2—2 of FIG. 3.
Figure 3:
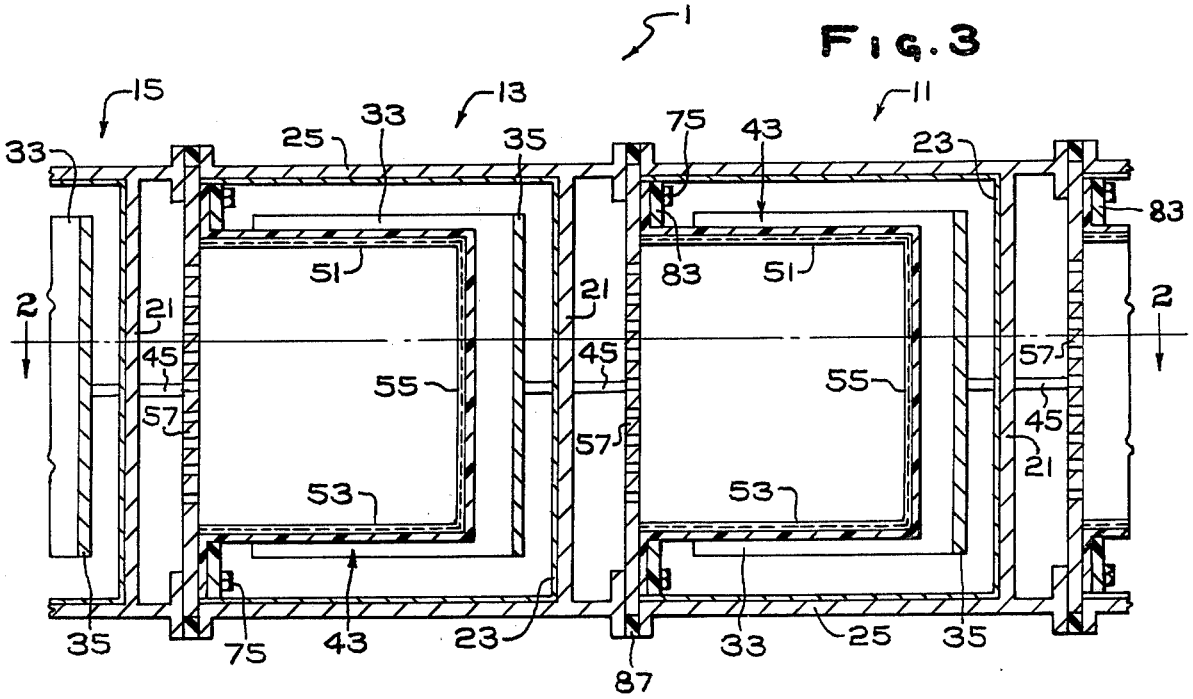
FIG. 3 is a cutaway plan view of a bipolar electrolyzer along plane 3—3 of FIG. 2.

A bipolar electrolyzer 1 has a plurality of individual bipolar units 11, 13, 15. Each individual bipolar unit has a backplate 21 with a valve metal lining 23 on the anodic side and walls 25 including side walls, top and bottom.

The bipolar unit 11 has an anodic unit 31 which includes anode blades 33 and anode supports 35. The anode supports provide electrical connection between the anode blades 33 and the valve metal lining 23 on the anodic side of the backplate 21. The anode blades 33 extend outwardly from the backplate 21 towards the opposite bipolar unit 13.

The cathodic unit 41 includes cathode fingers 43 extending from the cathodic surface of the backplate with valleys 59 between adjacent cathode fingers 43. Electrical connectors/conductors 45 provide electrical connection between the cathode fingers 43 and the bipolar unit 11. The cathode fingers 43 are in compression with the back screen 47 and can be individually removable through elastic clips as shown in U.S. Pat. No. 4,016,604. Alternatively, the cathode fingers 43 may be joined to the back screen 47, as by welding. While a "backscreen" is referred to, it is to be understood that the backscreen 47 may be either permeable or impermeable to the electrolyte.

Within the cathode there may be a single blade or porous body inside a hollow membrane support. Alternatively, as shown in the Figures, the cathode finger 43 may have a pair of walls 49, closed at the top 51, bottom 53, and leading edge 55, and open at the trailing edge 57 to communicate with a catholyte volume between the back plate 21 and the back screen 47.

The walls 49 of the cathode 43 can have means for spacing a separator 61 therefrom, for example, fins, blades, or the like. The synthetic separator, 61, e.g., a membrane or microporous diaphragm, is normally supported by the cathodes 43 and is part of the cathode structure.

While the bipolar unit 11 is described with the anode unit 31 being surrounded by electrolyte and having blade-like electrodes 33, and with the cathode fingers 43 bearing the membrane 61, it is to be understood that the anode and cathode structures can be reversed with the cathodes being blades or plates extending into a cathodic electrolyte and the anodes being hollow form structures surrounding the anodic electrolyte and bearing the separator 61. According to a still further exemplification both the anodes and the cathodes can be hollow fingers bearing membranes.

In the electrolytic cell herein contemplated, compressive means 71 extend from the bipolar unit 11 between the electrode fingers 43, bearing down upon the laps 70 of the synthetic separators 61, in the valleys 59, between adjacent cathode fingers 43. The compressive means 71 bear down upon the back screen 47 and the laps 70 of the synthetic separator 61 whereby to form an electrolyte-tight seal between the separators 61.

According to one exemplification, a frame 73 conforms to the electrode fingers 43 at their tops 57 and bottoms 53 and extends from one side 79 to the opposite side 81 of the cathode unit 41 with individual bearing means 83, e.g., arms, extending from top 75 to bottom 77. The arms 83 bear upon the laps 70. The arms 83 are joined to the frame 73, which frame is, in turn, bolted to the cathode unit 41 of the bipolar unit with bolts 85. In this way, bolt means 85 extending from the bipolar unit 11 cooperate with the compressive means 71.

According to a still further exemplification, the compressive means 71 may be held in place by gaskets 87 between the bipolar units 11. According to this alternative exemplification, the peripheral walls 25 of the electrolytic cell bear upon the frame 71 through gaskets 87 to provide compression and an electrolyte-tight seal.

According to a still further exemplification, the arms 83 can be bolted directly to the cathodic side 41 of the bipolar unit 11, e.g., utilizing bolts 85. In this way, the arms 83 are individually adjustable whereby to provide for non-uniformity of the back screen 47 or of the separator sheets or films 61.

The frame 73 and arms 83 can be a ceramic, a nonconductive metal, or a polymeric material, with, for example, gaskets bearing thereon.

While the compressive means 71, including the circumferential frame 73 and the individual arms 83, are spoken of as being joined to the bipolar unit 11 and to the cathodic unit 41 of the bipolar unit 11, it is to be understood that the compressive means 71 may bear upon the back plate 21, extensions of the back plate 21, or the back screen 47 of the cathodic unit 41 without changing the concept herein contemplated.

The synthetic separator 61 can be in the form of separate envelopes or gloves 63 for each finger 43 thereby avoiding chemical or thermal treatment of the separator 61 after partial assembly of electrode unit. The individual glove may have joints at the top 65, bottom 66, and leading edge 68 and laps 70 at the trailing edge 69. These seals and seams can be welded, sewn, heated, or chemically produced before placing the glove on the individual electrode finger 43. Alternatively, the individual glove may be a unitary seamless glove, e.g., an extruded, molded, or blow molded glove, inter alia.

While the invention has been described with reference to specific exemplifications and embodiments thereof, the invention is not to be so limited except as in the claims appended hereto.

I claim:

1. In an electrolytic cell having an electrode assembly comprising a base plate; fingered electrodes electrically connected to, spaced from, and extending perpendicularly outwardly from said base plate and defining valleys between a pair of adjacent fingered electrodes; a back screen spaced from and substantially parallel to said back plate, and interposed between said fingered electrodes and said backplate, said fingered electrodes having a top edge and a bottom edge extending from said backscreen, a leading edge remote from said backscreen, and a trailing edge adjacent said backscreen; said fingered electrodes bearing synthetic separators thereon; said synthetic separator being closed at the edges corresponding to the top, bottom, and leading edge of the fingered electrodes and open at the edge corresponding to the trailing edge thereof, with laps of synthetic separator material extending therefrom along said backscreen; and compressive means for sealing the laps of said synthetic separators, joined to the electrode assembly and bearing upon said electrode assembly and the laps of said synthetic separator material at the base of the electrode fingers between a pair of adjacent electrode fingers; the improvement wherein said compressive means comprises a frame bearing upon said backscreen and corresponding to the top and bottom of said electrode fingers and bearing means depending from said frame at the top of the electrode fingers to the frame at the bottom of the electrode fingers, and bearing upon said laps of synthetic separator material and said backscreen in the valleys between individual adjacent electrodes.

2. The electrolytic cell of claim 1, wherein said bearing means comprise rigid members joined to said frame.

3. The electrolytic cell of claim 1 wherein said electrolytic cell comprises a peripheral wall surrounding said electrode fingers and bearing upon and forming an electrolyte tight seal with said electrode assembly, and wherein said peripheral wall bears upon said compressive means at said seal.

4. The electrolytic cell of claim 1 wherein said compressive means is joined to said base plate.

5. The electrolytic cell of claim 4 wherein said base plate comprises bolt means cooperating with said compressive means.

6. The electrolytic cell of claim 1 wherein said electrodes are fabricated of an acidified brine resistant metal and have a chlorine discharge electrocatalyst thereon.

7. The electrolytic cell of claim 1 wherein said electrodes are fabricated of an alkali resistant metal.

8. The electrolytic cell of claim 1 wherein said synthetic separator is a cation selective permionic membrane.

9. The electrolytic cell of claim 1 wherein said synthetic separator is a microporous diaphragm.

* * * * *